United States Patent [19]

Krueger

[11] 4,158,116

[45] Jun. 12, 1979

[54] SNAP-ON HANDLE BLOCKING DEVICE

[75] Inventor: Keith T. Krueger, Bellefontaine, Ohio

[73] Assignee: Gould Inc., Rolling Meadows, Ill.

[21] Appl. No.: 844,621

[22] Filed: Oct. 25, 1977

[51] Int. Cl.[2] ..... H01H 9/28

[52] U.S. Cl. ..... 200/42 T; 200/44

[58] Field of Search ..... 200/42 R, 42 T, 44, 200/318, 321, 322, DIG. 6; 74/527, 528, 532; 335/38

[56] References Cited

U.S. PATENT DOCUMENTS

| | | | |
|---|---|---|---|
| 2,169,860 | 8/1939 | Von Hoorn | 200/44 X |
| 2,832,857 | 4/1958 | Landmeier | 200/42 T |
| 3,109,899 | 11/1963 | Pastene | 200/42 T |
| 3,170,050 | 2/1965 | Buturuga | 200/42 T |
| 3,376,400 | 4/1968 | Batt et al. | 200/42 T |

FOREIGN PATENT DOCUMENTS

| | | | |
|---|---|---|---|
| 787469 | 12/1957 | United Kingdom | 200/42 T |

*Primary Examiner*—Herbert F. Ross

*Attorney, Agent, or Firm*—Ostrolenk, Faber, Gerb & Soffen

[57] ABSTRACT

A single pole circuit breaker having a narrow housing is provided with a blocking device which prevents inadvertent manual operation of the circuit breaker. The blocking device is a single piece unit constructed of relatively stiff resilient metal formed with a generally flat main section having rearwardly extending short legs along opposite sides thereof. The legs are received within undercut portions of housing recesses positioned along opposite sides of the housing opening through which the handle extends. The blocking device is selectively positionable so as to prevent operation of the handle to either the ON or OFF position and the main section is provided with a window through which ON-OFF indicia, indicating handle position, is viewable.

7 Claims, 8 Drawing Figures

SNAP-ON HANDLE BLOCKING DEVICE

This invention relates to blocking devices to prevent inadvertent operation of electric switch handles and is an improvement over the blocking device illustrated in U.S. Pat. No. 2,937,248 issued May 17, 1960 to A. Michetti for A Circuit Breaker Handle Block.

The aforesaid U.S. Pat. No. 2,937,248 discloses a formed wire blocking device which is mounted directly on the handle of a relatively low capacity molded case circuit breaker. The construction of this prior art blocking device is such that an unauthorized, unknowledgeable person may readily operate the device to defeat its blocking function. Further, this prior art blocking device is mounted directly on the circuit breaker handle so that handle operation is often awkward in that the blocking device may interfere with effective gripping of the handle. Still further, while prior art blocking devices of the formed wire type may function satisfactorily with circuit breakers of relatively low rating, as circuit breaker size increases and wire lengths become greater the likelihood of distortion and/or damage to the blocking device increases under the circumstances circuit breaker operation may become awkward and the likelihood of malfunction increases.

In order to overcome these disadvantages of the prior art the instant invention provides a one piece blocking member constructed of relatively stiff spring sheet material which is snap-fitted directly on the circuit breaker housing. Mounting of the blocking device in a selected position to prevent either manual On or Off operation, as the case may be, does not require any tools. However, the snap-fit provides such a secure grip that it becomes awkward to detach the blocking device from the circuit breaker housing without the use of a tool. Almost any size screw driver or knife may be utilized for detaching the blocking device.

Accordingly, a primary object of the instant invention is to provide a novel low cost device for blocking manual operation of a circuit breaker handle.

Another object is to provide a blocking device of this type which does not require any tools for attachment thereof.

Still another object is to provide a blocking device of this type which, though requiring a tool for removal thereof, does not require the use of a special tool.

These objects as well as other objects of this invention shall become readily apparent after reading the following description of the accompanying drawings in which.

Figure 5:
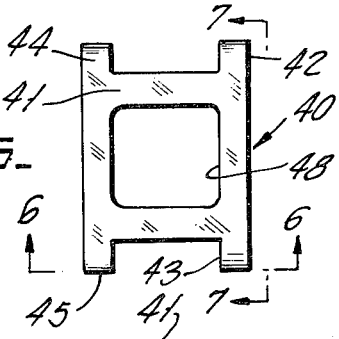
FIG. 5 is a front elevation of the blocking device.
Figure 7:
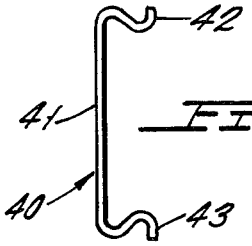
Figure 6:
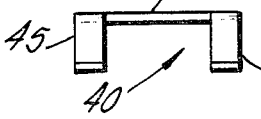

FIGS. 6 and 7 are end views of the blocking device of FIG. 5 looking in the directions of the respective arrows 6—6 and 7—7.

Figure 1:
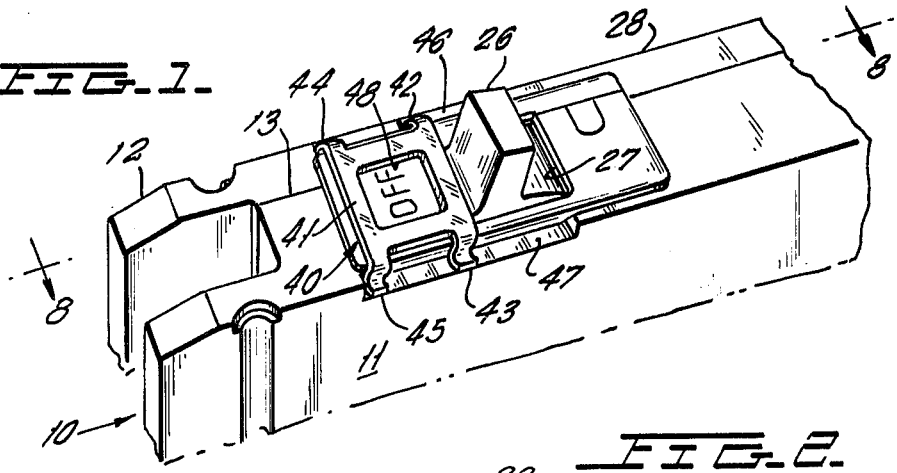
FIG. 1 is a fragmentary perspective of a single pole molded case circuit breaker showing the blocking device of the instant invention in operative position to prevent contact closing.
Figure 8:
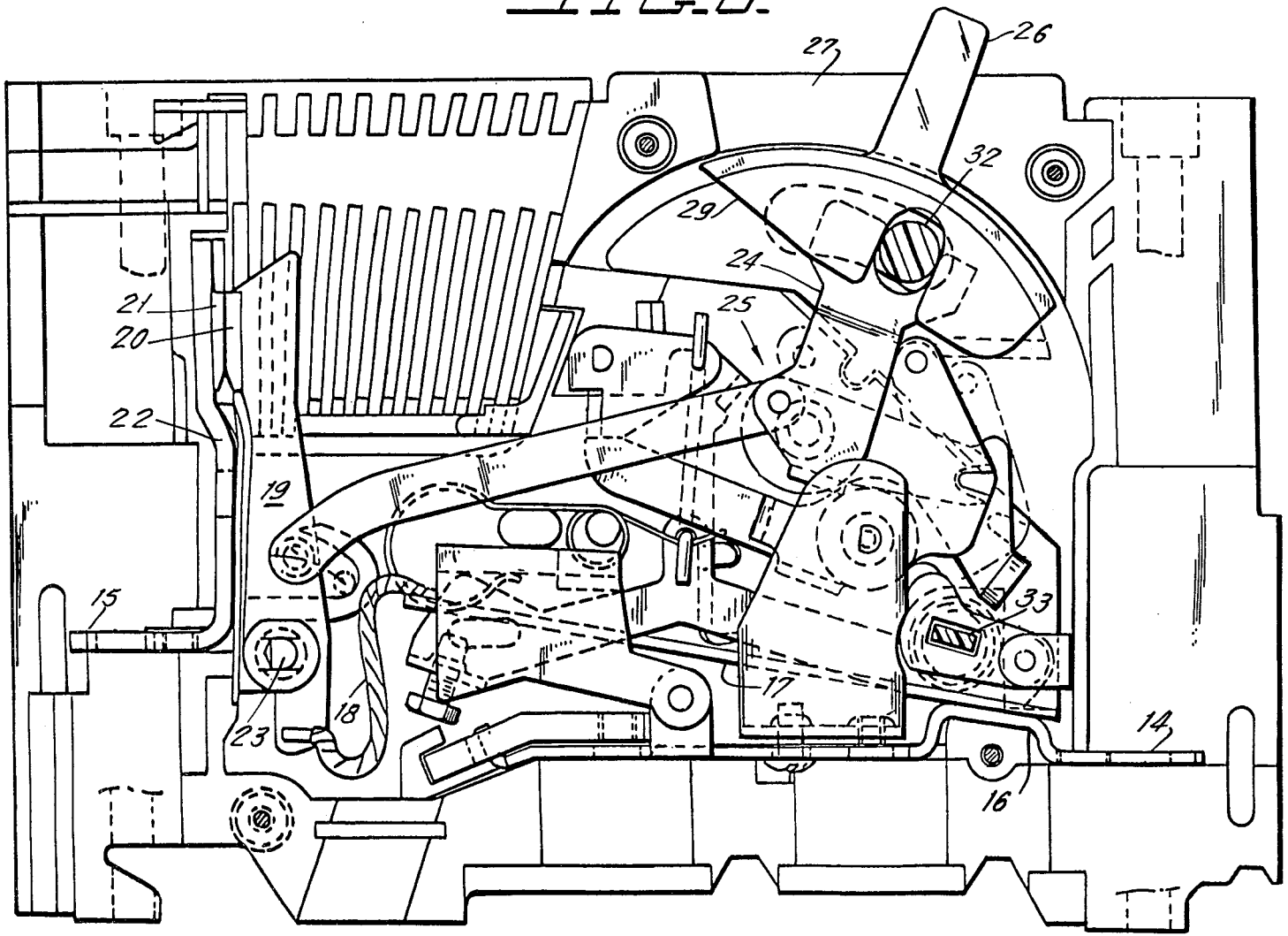

FIG. 8 is a side elevation of the circuit breaker of FIG. 1 looking in the direction of arrows 8—8 of FIG. 1 and showing the circuit breaker closed.

Now referring to the Figures. Single pole circuit breaker 10 of FIG. 1 is of the type described in detail in the T. J. Rys copending U.S. applications Ser. No. 703,078 filed July 6, 1976 and No. 763,888 filed Jan. 31, 1977. Briefly, circuit breaker 10 includes a molded insulating housing consisting of base 11 and cover 12 which mate along line 13. Disposed within housing 11, 12 are the current carrying elements and contact operating mechanism.

As seen in FIG. 8, the current path between load terminal 14 and line terminal 15, disposed at opposite ends of housing 11, 12, comprises load terminal member 16, directly heated elongated bi-metal 17, flexible braid 18, movable contact arm 19, movable contact 20, stationary contact 21 and line terminal member 22. Contact arm 19 is mounted on pivot 23 so as to be movable between circuit open and closed positions by trip free spring powered toggle-type operating mechanism 25. The latter includes operating member 24 provided with manually engageable handle 26 which extends through housing opening 27 beyond the narrow front surface of housing 11, 12.

Figure 2:
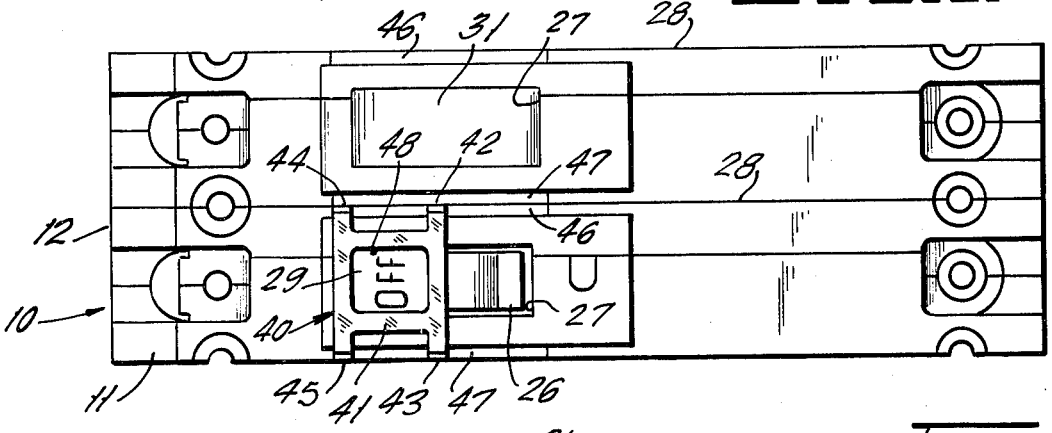
FIG. 2 is a front elevation of the circuit breaker of FIG. 1 stacked with another single pole circuit breaker.
Figure 3:
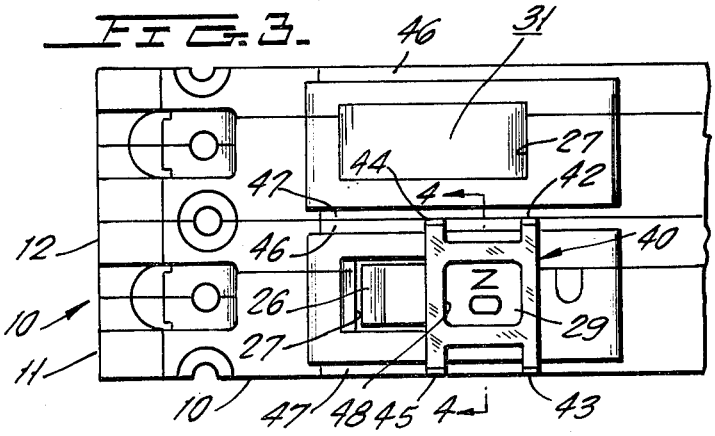
FIG. 3 is a fragmentary portion of FIG. 2 with a circuit breaker handle shown in the On position.

In FIGS. 2 and 3, circuit breaker 10 is shown stacked side-to-side with circuit breaker 28. These circuit breakers 10, 28 are identical except that the latter, instead of having handle member 29, is provided with cap 31 to close opening 27. Transverse tie rod 32 (FIG. 8) transmits manual operating forces from handle 26 to circuit breaker 28 and transverse bar 33 transmits automatic tripping impulses between circuit breakers 10 and 28.

Figure 4:
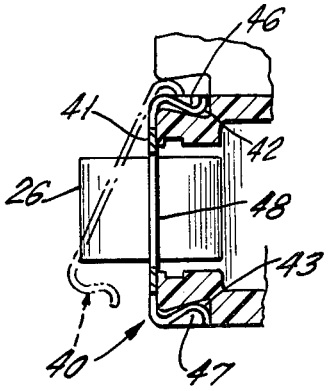
FIG. 4 is a cross-section of the blocking device taken through line 4—4 of FIG. 3 looking in the direction of arrows 4—4 and showing this blocking device mounted to a circuit breaker.

As seen in FIGS. 1 and 2 handle 26 is prevented from being operated to the On position by blocking device 40 which is a single member constructed of relatively stiff resilient sheet metal. Device 40 includes generally planar main section 41 and stubby legs 42–45 extending rearward from main section 41 at the corners thereof. Legs 42–45 extend into recesses provided by grooves 46, 47 formed in the sides of housing 11, 12 along the forward edges thereof in the region of opening 27. Each of the legs 42–45 is provided with a rounded inward protrusion which, as best seen in FIG. 4 nests within the undercut portions of grooves 46, 47. Main section 41 is provided with rectangular window 48 through which ON-OFF indicia on handle member 29 are viewable (see FIGS. 2 and 3).

In order to mount blocking device 40 on circuit breaker 10, device 40 is placed in the phantom position of FIG. 4 and then a rearwardly directed force is applied manually to main section 41 until device 40 snaps into its final mounting position wherein legs 42, 44 are disposed within groove 46 and legs 43, 45 are disposed within groove 47. During movement of device 40 from the phantom to solid line positions of FIG. 4, flexing of device 40 as the inward protrusions of legs 42–45 engages housing 11, 12, permits legs 42–45 to spread and then snap into the undercut portions of grooves 46, 47 to securely hold blocking device 40 mounted to circuit breaker 10. The left boundaries of grooves 46, 47 serve as barriers which are engaged by legs 44, 45 to limit movement of blocking device 40 to the left with respect to FIG. 2 when device 40 is mounted to prevent circuit breaker 10 from being turned On. Similarly, the right boundaries of grooves 46, 47 limit movement of blocking device 40 the the right with respect to FIG. 3 when device 40 is mounted to prevent manual Off operation of circuit breaker 10.

It is noted that blocking member 40 is constructed of relatively stiff resilient material so that legs 42–45 firmly grip circuit breaker 10, and ordinarily a tool is required to remove blocking device 40. The stubby construction of legs 42–45 limits flexing thereof as a further means for achieving reliable securement. A simple screwdriver of almost any size may be used to pry blocking device 40 off of circuit breaker 10.

Although there has been described a preferred embodiment of this invention, many variations and modifications will now be apparent to those skilled in the art. Therefore, this invention is to be limited, not by the specific disclosure herein, but only by the appended claims.

I claim:

1. An electrical switching unit including a housing, a manually operable contact operating member including a handle extending through a front opening of said housing, said handle being mounted for movement between a first and a second end of said opening wherein said handle is in respective contact open and contact closed positions, a blocking device secured to said housing in a first operative position wherein a main section of said blocking device is in front of a portion of said opening to block movement of said handle to one of said contact open and contact closed positions, said blocking device being selectively repositionable on said housing to a second operative position wherein said main section in front of another portion of said opening to block movement of said handle to the other of said contact open and contact closed portions, said housing at its front being elongated and said handle being movable longitudinally thereof, said blocking device at opposite sides of said main section also including leg means extending rearward of said main section into recesses defined by external surface portions of said housing disposed at opposite sides and outboard of said opening, said portions of said housing defining said recesses being undercut, each of said leg means including spaced legs having inwardly bent portions extending into said undercuts.

2. An electrical switching unit as set forth in claim 1 in which the blocking device is snap-fitted to the housing.

3. An electrical switching unit as set forth in claim 1 in which said main section is provided with a window through which ON-OFF indicia on said operating member is viewable.

4. An electrical switching unit as set forth in claim 1 in which the opening is elongated in the same direction as the front of said housing and the dimension of said main section taken parallel so the length of said front is approximately half the length of said opening.

5. An electrical switching unit as set forth in claim 1 in which the blocking device is a single member constructed of relatively stiff resilient sheet material.

6. An electrical switching unit as set forth in claim 5 in which each of said leg means includes spaced legs, and in cross-section taken transverse to the longitudinal axis of the front of the housing, the main section is many times longer than the length of the legs.

7. An electrical switching unit as set forth in claim 1 in which the leg means on one side of said main section includes a portion which extends toward a portion of the leg means on the other side of said main section.

* * * * *